US009322235B2

(12) United States Patent
Turley et al.

(10) Patent No.: US 9,322,235 B2
(45) Date of Patent: Apr. 26, 2016

(54) WEIGHT SETTING INDICATOR

(71) Applicant: Weatherford Technology Holdings, LLC, Houston, TX (US)

(72) Inventors: Rocky A. Turley, Houston, TX (US); Kathleen C. Cassard, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 362 days.

(21) Appl. No.: 13/796,352

(22) Filed: Mar. 12, 2013

(65) Prior Publication Data

US 2014/0262349 A1 Sep. 18, 2014

(51) Int. Cl.
*E21B 23/06* (2006.01)

(52) U.S. Cl.
CPC ..... *E21B 23/06* (2013.01)

(58) Field of Classification Search
CPC ..... E21B 23/06
See application file for complete search history.

(56) References Cited

U.S. PATENT DOCUMENTS

| | | | | |
|---|---|---|---|---|
| 5,015,132 A | | 5/1991 | Turner et al. | |
| 5,245,417 A | * | 9/1993 | Hibi et al. | 358/515 |
| 5,487,632 A | | 1/1996 | Hood et al. | |
| 5,813,458 A | * | 9/1998 | Smith et al. | 166/182 |
| 6,241,023 B1 | | 6/2001 | Krauss et al. | |
| 8,069,943 B2 | * | 12/2011 | Takahashi | B60R 21/38 180/274 |
| 2003/0155159 A1 | * | 8/2003 | Slack et al. | 175/423 |

FOREIGN PATENT DOCUMENTS

| | | |
|---|---|---|
| DE | 3142432 A1 | 5/1983 |
| GB | 1006452 A | 10/1965 |
| GB | 2107018 A | 4/1983 |
| GB | 2321919 A | 8/1998 |

OTHER PUBLICATIONS

Search Report and Written Opinion, dated Feb. 25, 2015, for International Application No. PCT/US2014/022531.

* cited by examiner

*Primary Examiner* — William P Neuder
(74) *Attorney, Agent, or Firm* — Patterson & Sheridan, L.L.P.

(57) ABSTRACT

The present invention generally relates to a weight setting indicator which is used to indicate that an applied force to a tool achieved or exceeded a predetermined amount. In one aspect, a packer actuator for use with a packer is provided. The packer actuator includes a body with a recess. The packer actuator further includes a dog assembly disposed in the recess of the body. The dog assembly is configured to set the packer when a force is applied to the packer actuator. The packer actuator also includes a setting indicator disposed in the recess adjacent an end of the dog assembly. The setting indicator is configured to move from a pre-set position to a post-set position when the force is applied to the packer actuator, wherein the setting indicator is plastically deformed in the post-set position.

27 Claims, 6 Drawing Sheets

WEIGHT SETTING INDICATOR

BACKGROUND OF THE INVENTION

1. Field of the Invention

Embodiments of the present invention generally relate to a downhole tool. More particularly, embodiments of the present invention relate to a weight setting indicator for a downhole tool.

2. Description of the Related Art

It is common to employ more than one string of casing in a wellbore. In this respect, a first string of casing is set in the wellbore when the well is drilled to a first designated depth. The first string of casing is hung from the surface, and then cement is circulated into the annulus behind the casing. The well is then drilled to a second designated depth, and a second string of casing, or liner, is run into the well. The second string is set at a depth, such that the upper portion of the second string of casing overlaps with the lower portion of the upper string of casing. The second "liner" string is then fixed or "hung" off of the inner surface of the upper string of casing. Afterwards, the liner string is also cemented. This process is typically repeated with additional liner strings until the well has been drilled to total depth. In this manner, wells are typically formed with two or more strings of casing of an ever-decreasing diameter.

The process of hanging a liner off of a string of surface casing or other upper casing string involves the use of a liner hanger. The traditional liner hanger uses surface weight to set a liner top packer. This downward movement typically seals the packer's element and/or seal mechanism. Liner top packers are typically located thousands of feet downhole below the surface in the wellbore. In many cases the wellbore has a vertical section and a horizontal section. The liner top packer may be located in the horizontal section of the wellbore, and thus the liner top packer may have a horizontal position. The horizontal position of the liner top packer can result in a corkscrewing effect, called "slack off" on the drill pipe and the running string of the drill pipe. Due to "slack off" the downhole packer may or may not actually be seeing the same amount of weight downhole as being applied at the surface. There is a need for a downhole packer weight indicator to verify that the desired packer setting weight was applied to the packer

SUMMARY OF THE INVENTION

The present invention generally relates to a weight setting indicator which is used to indicate that an applied force to a tool achieved or exceeded a predetermined amount. In one aspect, a packer actuator for use with a packer is provided. The packer actuator includes a body. The packer actuator further includes a dog assembly disposed on the body. The dog assembly is configured to set the packer when a force is applied to the packer actuator. The packer actuator also includes a setting indicator that is disposed between the dog assembly and a portion of the body. The setting indicator is configured to move from a pre-set position to a post-set position when the force is applied to the packer actuator, wherein the setting indicator is plastically deformed in the post-set position.

In another aspect, a method of setting a packer in a wellbore using a packer actuator is provided. The method includes the steps of positioning the packer and the packer actuator in the wellbore, the packer actuator having a setting indicator. The method further includes the step of setting the packer by applying a force to the packer actuator. The method also includes the step of plastically deforming the setting indicator as a result of applying the force to the packer actuator.

In a further aspect, a setting indicator for use with a packer actuator is provided. The setting indicator includes a base. The setting indicator further includes a protrusion on the base. The protrusion having a first height relative to the base in a pre-set position and a second smaller height relative to the base in a post-set position. The protrusion is plastically deformed in the post-set position.

In one aspect, a packer actuator for use with a packer is provided. The packer actuator includes a body. The packer actuator further includes a dog assembly disposed on the body. The dog assembly is configured to set the packer when a force is applied to the packer actuator. The packer actuator also includes a setting indicator disposed between the dog assembly and a portion of the body. The setting indicator includes a first ring member that is separated from a second ring member at a first distance when the setting indicator is in a pre-set position and at a second distance when the setting indicator is in a post-set position. The second distance is different than the first distance. The setting indicator is configured to move from the pre-set position to the post-set position when the force is applied to the packer actuator.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

The present invention generally relates to a weight setting indicator which, is used to indicate that an applied force to a tool exceeded a predetermined amount. The weight setting indicator will be described herein in relation to packer that is used in the wellbore. It is to be understood, however, that the weight setting indicator may also be used with other downhole tools without departing from principles of the present invention. To better understand the novelty of weight setting indicator of the present invention and the methods of use thereof, reference is hereafter made to the accompanying drawings.

Figure 1:
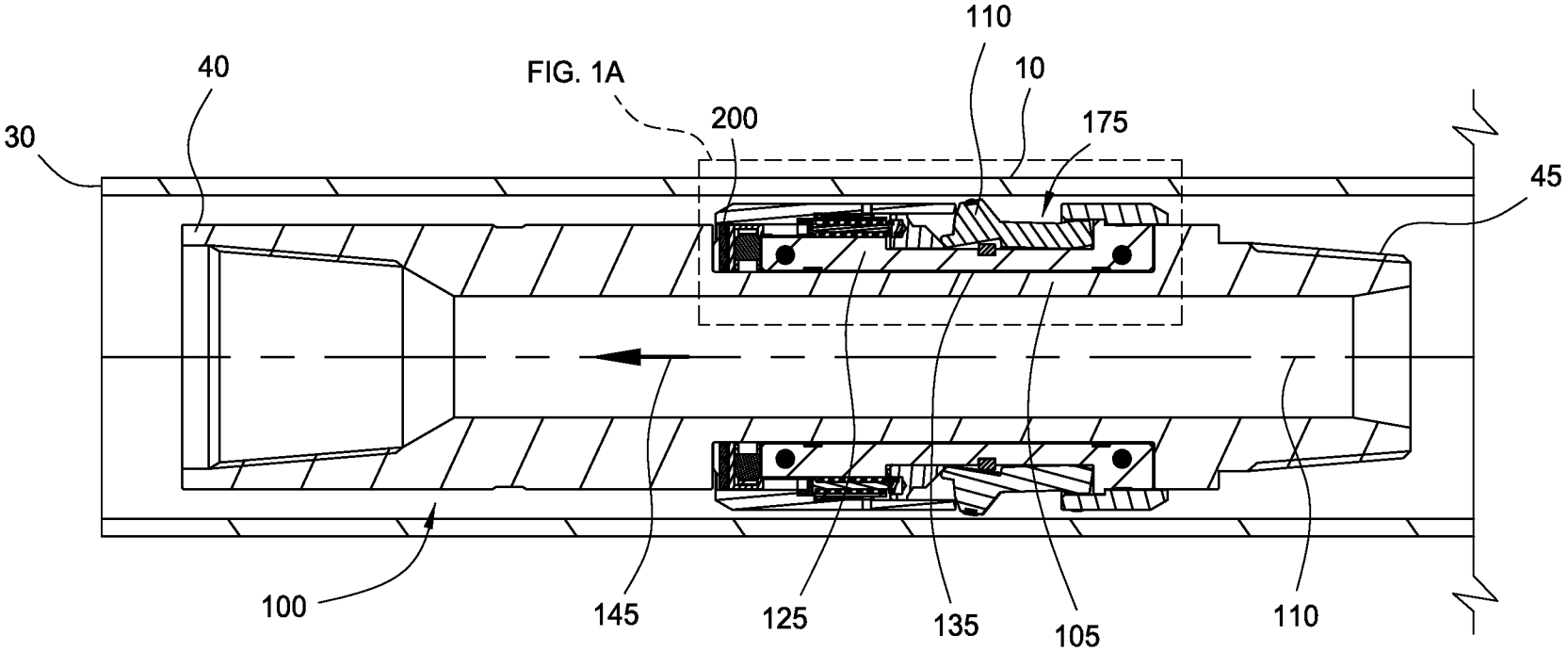
FIG. 1 is a view illustrating a packer actuator in a run-in position.

FIG. 1 is a view illustrating a packer actuator 100 in a run-in position. Generally, the packer actuator 100 is configured to actuate a packer (not shown) when an applied force (i.e., surface weight) from a workstring is applied to the packer actuator 100. The packer actuator 100 includes a first end 40 that is attachable to a workstring (not shown), and a second end 45 that is attachable to a tool (not shown), such as a run-in tool or a service tool, which is attached to the packer. The packer actuator 100 further includes a weight setting indicator 200 that is used to indicate that the applied force to the packer actuator 100 exceeded a predetermined amount. The weight setting indicator 200 is movable from a pre-set position to a post-set position during the setting sequence of the packer.

As shown in FIG. 1, the packer actuator 100 is disposed in a PBR 10. The PBR 10 is attached to the liner assembly. The packer actuator 100 uses the PBR 10 to set the packer in the liner assembly. The packer actuator 100 includes a body 105 with a bore 110. The body 105 includes a recess 135 formed in a wall of the body 105. The recess 135 is configured to receive a dog assembly 175. During the setting sequence of the packer, the dog assembly 175 is configured to interact with an end 30 of the PBR 10.

Figure 1A:
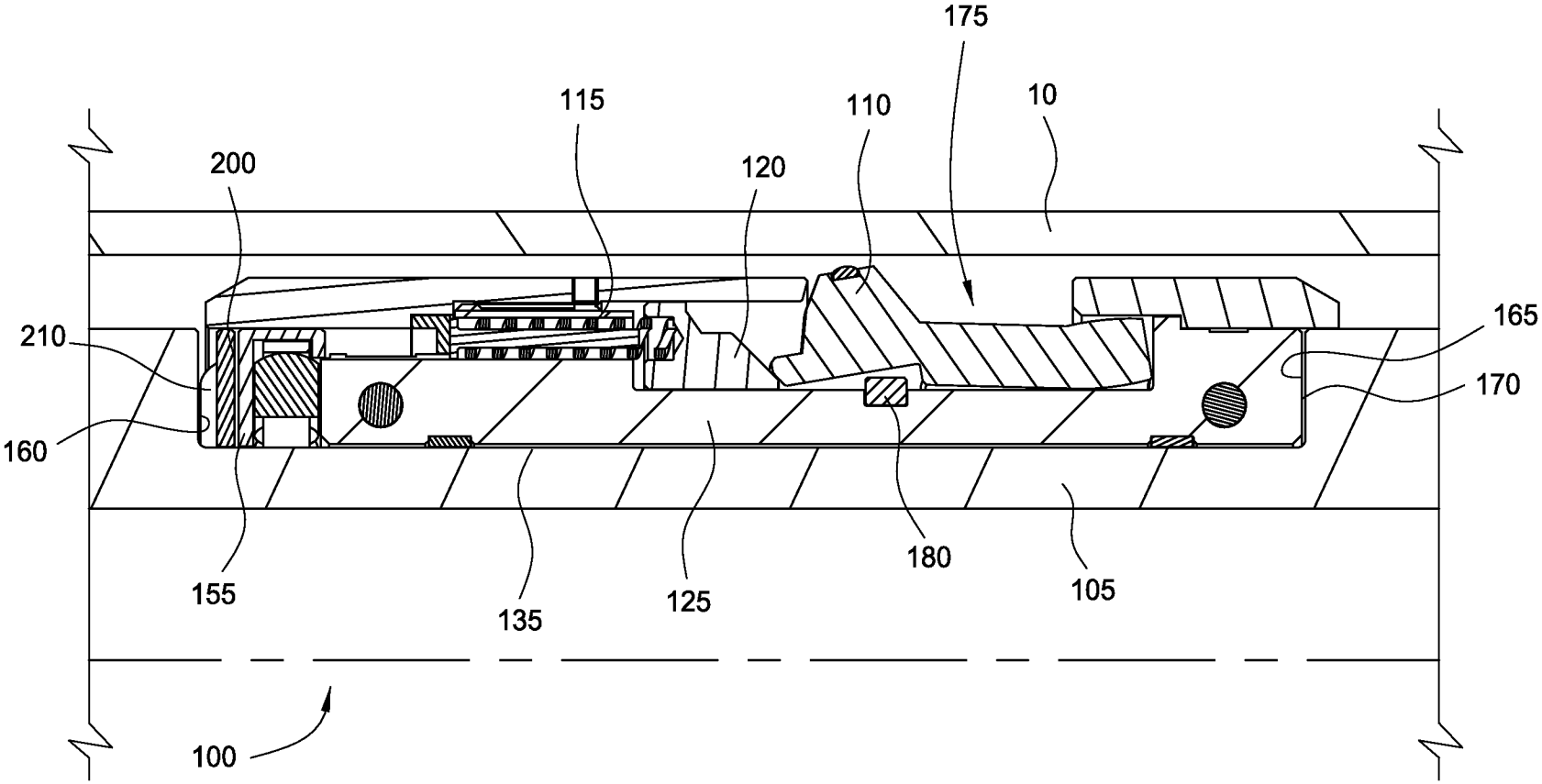
FIG. 1A is a view illustrating a weight setting indicator in the packer actuator.
Figure 2:
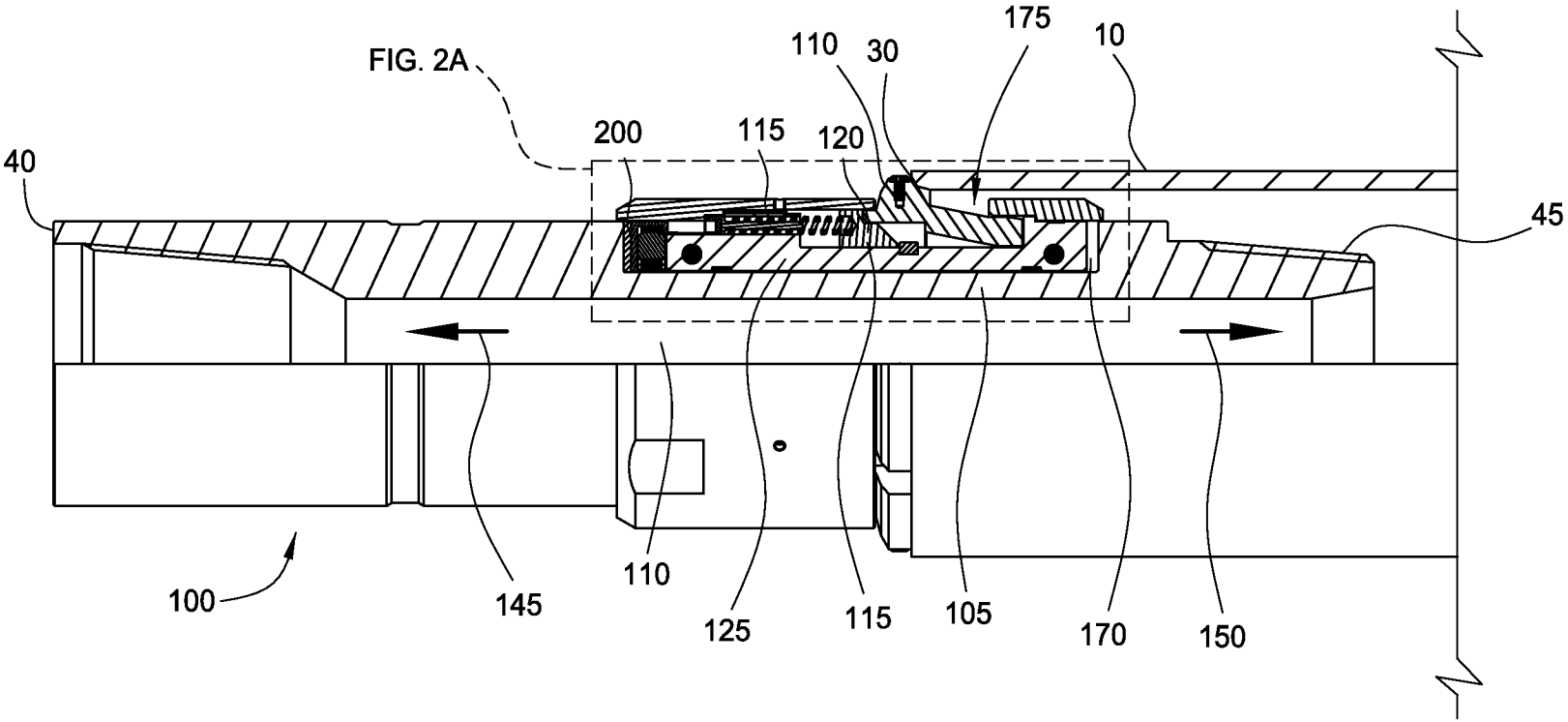
FIG. 2 is a view illustrating the packer actuator in a set position.

The dog assembly 175 includes dogs 110 that are movable between a retracted position (FIG. 1) and an extended position (FIG. 2). As shown in FIG. 1A, the dog assembly 175 includes a support assembly 125 having a first end 155 and a second end 170. The dog assembly 175 further includes a biasing member 115, such as a spring, that is configured to urge a wedge member 120 under the dogs 110 until the wedge member 120 contacts a stop 180. The movement of the wedge member 120 causes the dogs 110 to move from the retracted position to the extended position.

As shown in FIG. 1A, the weight setting indicator 200 is positioned between the first end 155 of the support assembly 125 and a first side 160 of the recess 135. As will be described herein, the weight setting indicator 200 will be compressed between the first end 155 of the support assembly 125 and the first side 160 of the recess 135, such that the weight setting indicator 200 is plastically deformed when the packer is set. The second end 170 of the support assembly 125 is disposed adjacent a second side 165 of the recess 135. The weight setting indicator 200 is shown in the pre-set position in FIG. 1A. The weight setting indicator 200 may be made from a material that bends, crushes, deforms or collapses under compression, such as metal, when the applied forces reach a threshold value. To start the setting sequence of the packer, the packer actuator 100 is moved through the PBR 10 in the direction indicated by direction arrow 145.

FIG. 2 is a view illustrating the packer actuator 100 in a set position. The packer actuator 100 is pulled through the PBR 10 in the direction indicated by direction arrow 145 until the dogs 110 are positioned outside of the PBR 10. Next, the biasing member 115 urge the wedge member 120 under the dogs 110 which causes the dogs 110 to move from the retracted position to the extended position. The wedge member 110 may also be configured to lock the dogs 110 in the extended position. Thereafter, the packer actuator 100 is moved in the direction indicated by direction arrow 150 until the dogs 110 engage the end 30 of the PBR 10. The packer actuator 100 is now ready to set the packer.

To set the packer, a force (i.e., surface weight) from the workstring is applied to the packer actuator 100 in the direction indicted by direction arrow 150. The force is transferred from the dogs 110 in the dog assembly 175 of the packer actuator 100 to the PBR 10. The force causes the PBR 10 to move in the direction indicted by direction arrow 150, and the movement of the PBR 10 sets the packer. At substantially the same time, the weight setting indicator 200 is compressed between the first end 155 of the support assembly 125 of the dog assembly 175 and the first side 160 of the recess 135. The weight setting indicator 200 is configured to plastically deform when it is compressed. The weight setting indicator 200 is shown in the post-set position in FIG. 2A. It is noted that the weight setting indicator 200 remains intact in the post-set position.

Figure 2A:
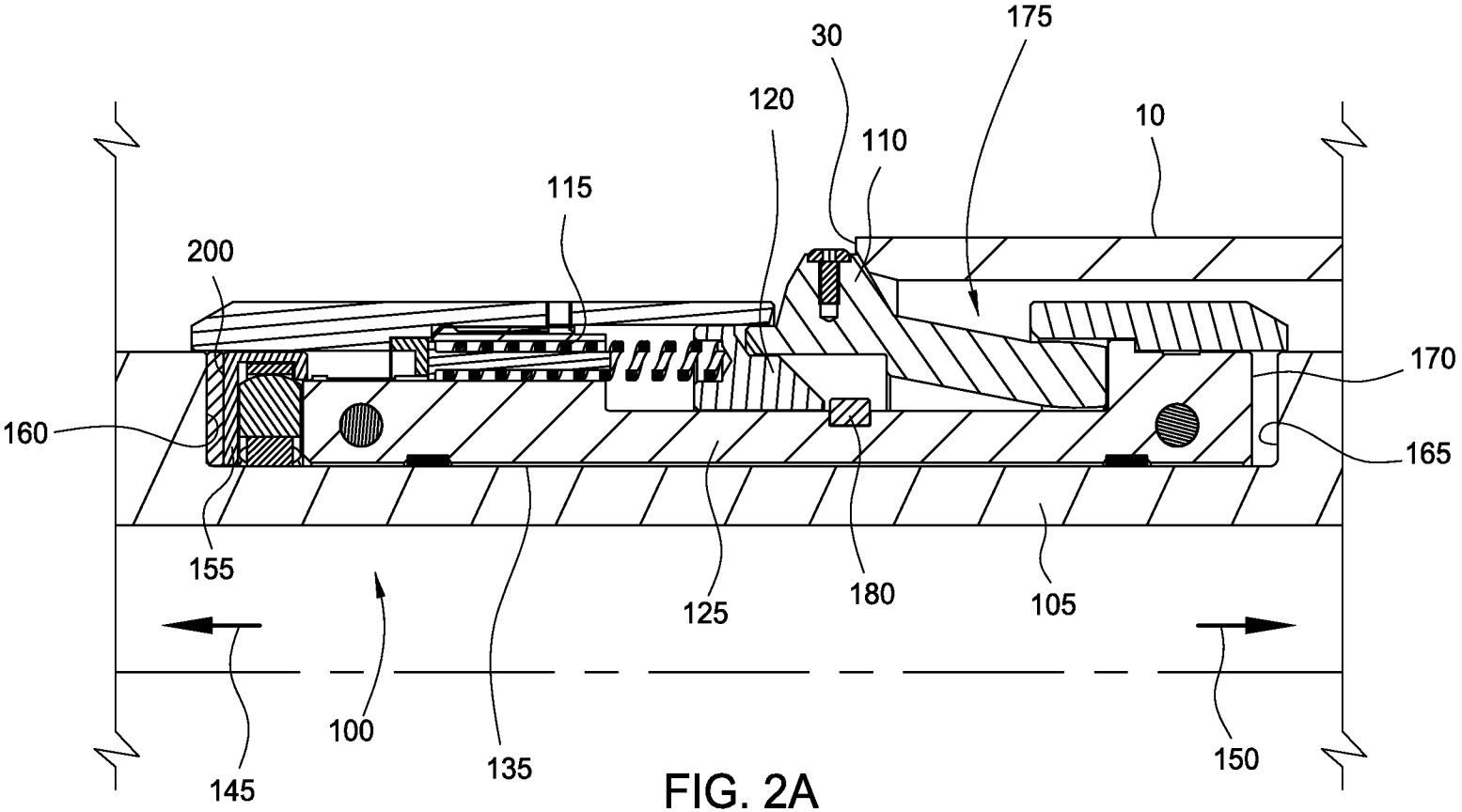
FIG. 2A is a view illustrating the weight setting indicator in the packer actuator.

As shown in FIG. 2A, the dog assembly 175 has moved within the recess 135 in the direction indicated by direction arrow 145. The movement of the dog assembly 175 in the recess 135 causes the weight setting indicator 200 to be compressed (or crushed) between the end 155 of the support assembly 125 and the first side 160 of the recess 135. The force applied to the end 30 of the PBR 10 by the dogs 110 of the dog assembly 175 in the direction indicated by direction arrow 150 to set the packer is substantially the same as the force required to plastically deform the weight setting indicator 200. The weight setting indicator 200 is designed and configured to collapse or to be crushed (and plastically deform) when the compressive forces reach a threshold value. The threshold value force for the weight setting indicator corresponds to the desired value of the force required to set the packer. For example, if the desired value for the force to set the packer is 5000 pounds, then the threshold value for the force to move the weight setting indicator 200 from the pre-set position to the post-set position is equal to 5000 pounds or greater than 5000 pounds. In this manner, the weight setting indicator 200 can be used as an indicator to verify that the desired packer setting weight was applied to the packer.

In another embodiment, a weight setting indicator (not shown) is disposed between the end 170 of the support assembly 125 and the second side 165 of the recess 135. The weight setting indicator may be attached to the end 170 and the second side 165 by a connection member or an adhesive. The weight setting indicator has a first length in a pre-set position and a second greater length in a post-set position. The weight setting indicator is configured to elongate (stretch or expand) when the dog assembly 175 moves in the recess 135. Specifically, as the end 170 of the support assembly 125 moves apart from the second side 165 of the recess 135 (compare FIGS. 1A and 2A); tensile forces are applied to the weight setting indicator. The weight setting indicator is designed to elongate (and plastically deform) when the tensile forces reach a threshold value. The threshold value force for the weight setting indicator corresponds to the desired value of the force required to set the packer. The movement of the weight setting indicator from the pre-set position (i.e., first length) to the post-set position (i.e., second greater length) can be used as an indicator to verify that the desired packer setting weight was applied to the packer. It is noted that the weight setting indicator remains intact in the post-set position. In another embodiment, the weight setting indicator may break into a first piece and a second piece when the tensile forces reach a threshold value. The movement of the weight setting indicator from a pre-set position (i.e., one piece) to the post-set position (i.e., two pieces) can be used as an indicator to verify that the desired packer setting weight was applied to the packer.

Figure 3:
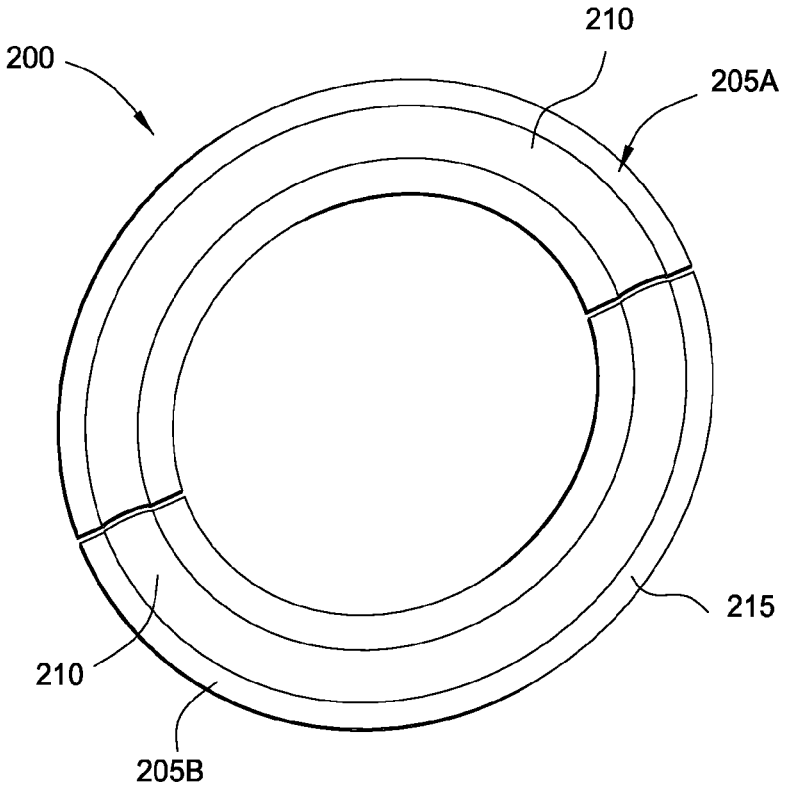
FIG. 3 is a view illustrating the weight setting indicator.
Figure 4:
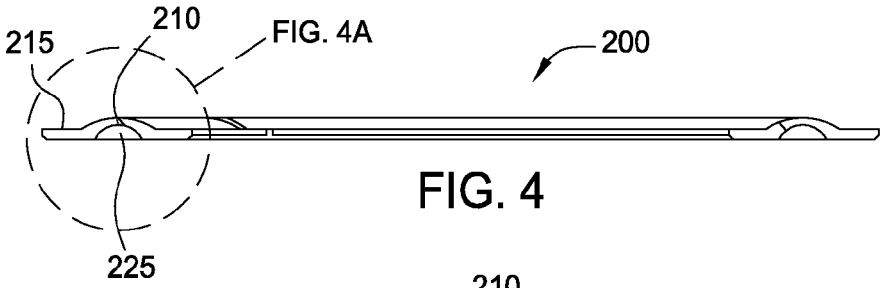
FIG. 4 is a view illustrating a side of the weight setting indicator.

FIG. 3 is a view illustrating the weight setting indicator 200. As shown, the weight setting indicator 200 is a ring member that includes a first piece 205A and a second piece 205B. In another embodiment, the weight setting indicator 200 is a single piece. The weight setting indicator 200 includes a profile 210 around the circumference. As shown in FIG. 4, the profile 210 extends from a base 215 of the weight setting indicator 200. The profile 210 is designed to collapse when the weight setting indicator 200 moves from the pre-set position to the post-set position. The profile 210 creates a cavity 225 in the weight setting indicator 200. The cavity 225 has a first volume when the weight setting indicator 200 is in the pre-set position and a second smaller volume when the weight setting indicator 200 is in the post-set position.

Figure 4A:
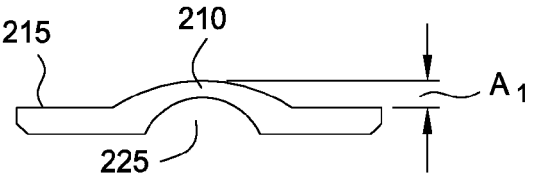
FIG. 4A is a view illustrating a portion of the weight setting indicator in a pre-set position.
Figure 4B:
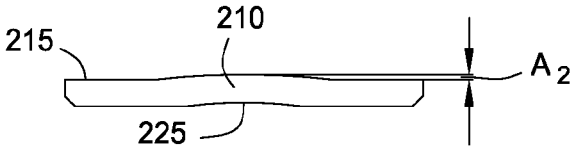
FIG. 4B is a view illustrating a portion of the weight setting indicator in a post-set position.

FIG. 4A is a view illustrating a portion of the weight setting indicator 200 in the pre-set position. As shown, the profile 210 extends from the base 215 of the weight setting indicator 200 by height $A_1$ when the weight setting indicator 200 is in the pre-set position. The height $A_1$ may be in the range of 0.125 to 1.0 inch. FIG. 4B is a view illustrating a portion of the weight setting indicator 200 in a post-set position. As shown, the profile 210 extends from the base 215 of the weight setting indicator 200 by height $A_2$ when the weight setting indicator 200 is in the post-set position. The height $A_2$ may be in the range of 0.0625 to 0.125 inch. In comparing FIGS. 4A and 4B, the difference between $A_1$ and $A_2$ can be seen. Thus, when an operator visually inspects the weight setting indicator 200 after the setting sequence of the packer, and the packer actuator 100 has been removed from the wellbore, it can be seen that the desired packer setting weight was applied to the packer. It is noted that the weight setting indicator 200 remains intact in the post-set position. As shown in FIG. 4B, the weight setting indicator 200 remains intact in the post-set position.

Figure 5:
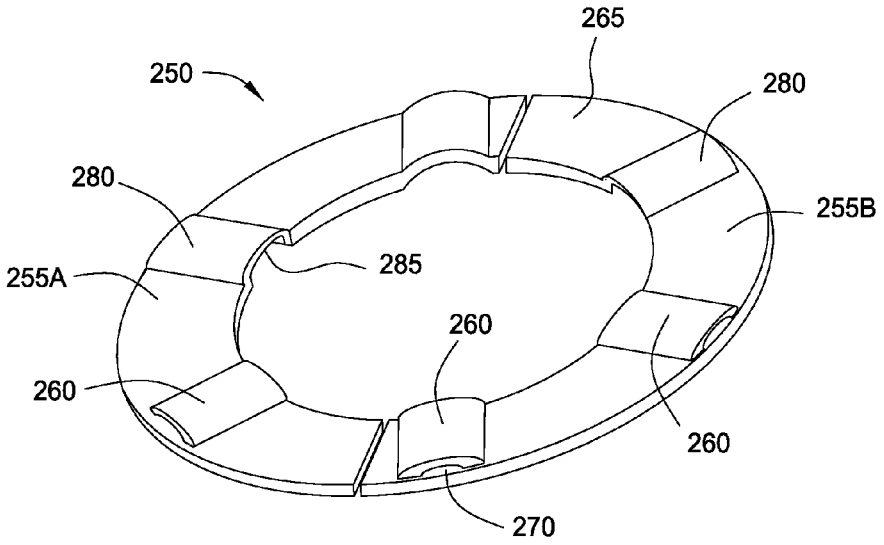
FIG. 5 is a view illustrating a weight setting indicator.

FIG. 5 is a view illustrating a weight setting indicator 250. As shown, the weight setting indicator 250 is a ring member that includes a first piece 255A, and a second piece 255B. In another embodiment, the weight setting indicator 250 is a single piece. The weight setting indicator 250 may be used in the packer actuator 100 in a similar manner as described herein in relation to FIGS. 1 and 2.

The weight setting indicator 250 includes a plurality of profiles 280 that are formed in a base 265. The profiles 280 extend from the base 265 at a first height when the weight setting indicator 250 is in the pre-set position, and a second smaller height when the weight setting indicator 250 is in the post-set position. The profiles 280 are designed to collapse when the weight setting indicator 250 moves from the pre-set position to the post-set position. Thus, the weight setting indicator 250 may be used to verify that the desired packer setting weight was applied to the packer. Each profile 280 creates a cavity 285 in the weight setting indicator 200. The cavity 285 has a first volume when the weight setting indicator 250 is in the pre-set position and a second smaller volume when the weight setting indicator 250 is in the post-set position. The profiles 280 may extend around the entire circumference of the weight setting indicator 250. In another embodiment, profiles 260 may be attached to the base 265 by a connection member, an adhesive or welding. Similar to the profiles 280, the profiles 260 are designed to collapse when the weight setting indicator 250 moves from the pre-set position to the post-set position. A cavity 270 is formed between the profile 260 and the base 265. The cavity 270 has a first volume when the weight setting indicator 250 is in the pre-set position and a second smaller volume when the weight setting indicator 250 is in the post-set position. The profiles 260 may extend around the entire circumference of the weight setting indicator 250.

The profiles 260, 280 (in the collapsed state) may be used as a visual indicator that that the desired packer setting weight was applied to the packer, as discussed herein. In addition, profiles 260, 280 (in the collapsed state) may be used as a visual indicator that the desired packer setting weight was uniformly applied to the packer. For instance, if each profile 260, 280 extends from the base 265 at substantially the same height in the post-set position, then the desired packer setting weight was uniformly applied to the packer. However, if several profiles 260, 280 extend from the base 265 at a different height relative to the height of other profiles 260. 280 in the post-set position, then the desired packer setting weight may not have been uniformly applied to the packer. In other words, the pattern of deformation of the profiles 260, 280 may be used to determine if the desired packer setting weight has been uniformly applied to the packer or not uniformly applied to the packer.

Figure 6A:
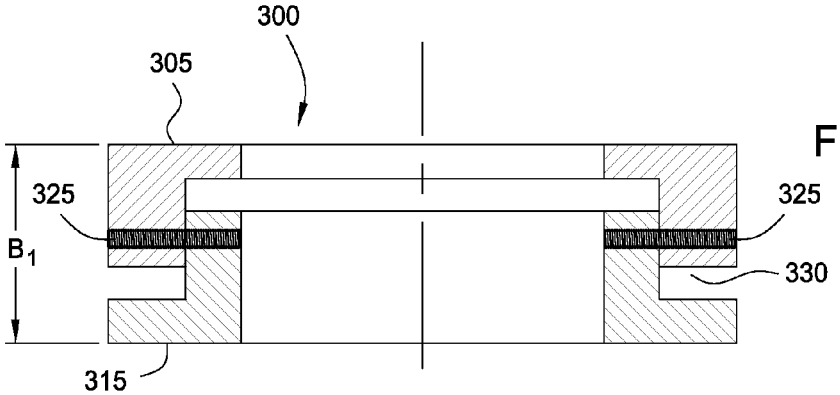
FIG. 6A is a view illustrating a weight setting indicator in a pre-set position.
Figure 6B:
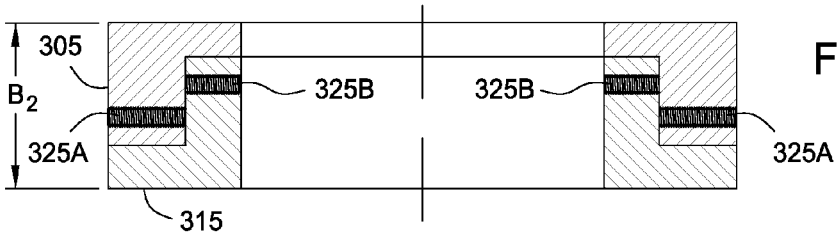
FIG. 6B is a view illustrating the weight setting indicator in a post-set position.

FIG. 6A is a view illustrating a weight setting indicator 300 in a pre-set position, and FIG. 6B is a view illustrating the weight setting indicator 300 in a post-set position. As shown, the weight setting indicator 300 includes a first ring member 305 and a second ring member 315. A cavity 330 is formed around the circumference of the weight setting indicator 300 between the ring members 305, 315. The cavity 330 has a first volume when the weight setting indicator 300 is in the pre-set position and a second smaller volume (or no volume), when the weight setting indicator 300 is in the post-set position. The weight setting indicator 300 may be used in the packer actuator 100 in a similar manner as described herein in relation to FIGS. 1 and 2.

The ring members 305, 315 are connected by releasable members 325, such as shear screws. The releasable members 325 are configured to fail when the compressive forces reach a threshold value. The threshold value force for the releasable members 325 in the weight setting indicator 300 corresponds to the desired value of the force required to set the packer. As shown, the weight setting indicator 300 has a height $B_1$, when the weight setting indicator 300 in the pre-set position and a height $B_2$, when the weight setting indicator 300 in the post-set position. In comparing FIGS. 6A and 6B, the difference between $B_1$ and $B_2$ can be seen. Thus, when an operator visually inspects the weight setting indicator 300 after the setting sequence of the packer, and the packer actuator 100 has been removed from the wellbore, it can be seen that the desired packer setting weight was applied to the packer. In other words, the first ring member 305 is separated from the second ring member 315 at a first distance when the setting indicator is in a pre-set position and at a second smaller distance when the setting indicator is in a post-set position. In other embodiment, the weight setting indicator 300 may be placed between the end 170 of the support assembly 125 and the second side 165 of the recess 135. The weight setting indicator 300 may be attached to the end 170 and the second side 165 by a connection member or an adhesive. In this embodiment, the first ring member 305 is separated from the second ring member 315 at a first distance when the setting indicator 300 is in a pre-set position and at a second larger distance when the setting indicator 300 is in a post-set position.

In one embodiment, a packer actuator for use with a packer is provided. The packer actuator includes a body. The packer actuator further includes a dog assembly disposed on the body. The dog assembly is configured to set the packer when a force is applied to the packer actuator. The packer actuator also includes a setting indicator that is disposed between the dog assembly and a portion of the body. The setting indicator is configured to move from a pre-set position to a post-set position when the force is applied to the packer actuator, wherein the setting indicator is plastically deformed in the post-set position.

In one or more embodiments, the setting indicator is a ring member having a base and a protrusion that extends from the base.

In one or more embodiments, the protrusion has a first height relative to the base in the pre-set position and a second smaller height relative to the base in the post-set position.

In one or more embodiments, the profile creates a cavity in the base of the weight setting indicator.

In one or more embodiments, the cavity has a first volume in the pre-set position and a second smaller volume in the post-set position.

In one or more embodiments, the profile is disposed along the circumference of the base.

In one or more embodiments, the setting indicator is a ring member having a base and a plurality of protrusions disposed around the circumference of the base.

In one or more embodiments, the protrusions have a first height relative to the base in the pre-set position and a second smaller height relative to the base in the post-set position.

In one or more embodiments, the dog assembly and the setting indicator are disposed in a recess formed in the body.

In one embodiment, a method of setting a packer in a wellbore using a packer actuator is provided. The method includes the steps of positioning the packer and the packer actuator in the wellbore, the packer actuator having a setting indicator. The method further includes the step of setting the packer by applying a force to the packer actuator. The method also includes the step of plastically deforming the setting indicator as a result of applying the force to the packer actuator.

In one or more embodiments, the setting indicator is activated by moving the setting indicator from a pre-set position to a post-set position.

In one embodiment, a setting indicator for use with a packer actuator is provided. The setting indicator includes a base. The setting indicator further includes a protrusion on the base. The protrusion having a first height relative to the base in a pre-set position and a second smaller height relative to the base in a post-set position. The protrusion is plastically deformed in the post-set position.

In one or more embodiments, a second protrusion and a third protrusion are disposed on the base.

In one or more embodiments, the amount of plastic deformation of each protrusion indicates the uniformity of force applied to the setting indicator.

In one or more embodiments, the protrusion is formed in the base.

In one or more embodiments, the protrusion is attached to the base.

In one embodiment, a packer actuator for use with a packer is provided. The packer actuator includes a body. The packer actuator further includes a dog assembly disposed on the body. The dog assembly is configured to set the packer when a force is applied to the packer actuator. The packer actuator also includes a setting indicator disposed between the dog assembly and a portion of the body. The setting indicator includes a first ring member that is separated from a second ring member at a first distance when the setting indicator is in a pre-set position and at a second distance when the setting indicator is in a post-set position. The second distance is different than the first distance. The setting indicator is configured to move from the pre-set position to the post-set position when the force is applied to the packer actuator.

In one or more embodiments, the first ring member is connected to the second ring member by a releasable connection when the setting indicator is in the post-set position.

In one or more embodiments, the second distance is smaller than the first distance.

In one or more embodiments, the second distance is larger than the first distance.

While the foregoing is directed to embodiments of the present invention, other and further embodiments of the invention may be devised without departing from the basic scope thereof, and the scope thereof is determined by the claims that follow.

The invention claimed is:

1. A packer actuator for use with a packer, the packer actuator comprising:

a body;

a dog assembly disposed on the body, the dog assembly being configured to set the packer when a force is applied to the packer actuator; and a setting indicator disposed between the dog assembly and a portion of the body, the setting indicator being configured to move from a pre-set position to a post-set position when the force is applied to the packer actuator, wherein the setting indicator is plastically deformed in the post-set position, and wherein the setting indicator is a ring member having a base and a protrusion that extends from the base.

2. The packer actuator of claim 1, wherein the protrusion has a first height relative to the base in the pre-set position and a second smaller height relative to the base in the post-set position.

3. The packer actuator of claim 1, wherein the protrusion creates a cavity in the base of the weight setting indicator.

4. The packer actuator of claim 3, wherein the cavity has a first volume in the pre-set position and a second smaller volume in the post-set position.

5. The packer actuator of claim 1, wherein the protrusion is disposed along the circumference of the base.

6. The packer actuator of claim 1, wherein the base includes a plurality of protrusions disposed around the circumference of the base.

7. The packer actuator of claim 6, wherein the protrusions have a first height relative to the base in the pre-set position and a second smaller height relative to the base in the post-set position.

8. The packer actuator of claim 1, wherein the dog assembly and the setting indicator are disposed in a recess formed in the body.

9. A method of setting a packer in a wellbore using a packer actuator; the method comprising:

positioning the packer and the packer actuator in the wellbore, the packer actuator having a setting indicator;

setting the packer by applying a force to the packer actuator; and plastically deforming the setting indicator as a result of applying the force to the packer actuator, wherein the setting indicator is a ring member having a base and a protrusion that extends from the base.

10. The method of claim 9, further comprising moving the setting indicator from a pre-set position to a post-set position when plastically deformed.

11. The method of claim 10, wherein the setting indicator has a first height in the pre-set position and a second smaller height in the post-set position.

12. The method of claim 10, wherein the protrusion creates a cavity in the setting indicator that has a first volume in the pre-set position and a second smaller volume in the post-set position.

13. A setting indicator for use with a packer actuator, the setting indicator comprising:

a base; and a plurality of protrusions on the base, each protrusion having a first height relative to the base in a pre-set position and a second smaller height relative to the base in a post-set position, each protrusion being plastically deformed in the post-set position, wherein the amount of plastic deformation of each protrusion indicates the uniformity of force applied to the setting indicator.

14. The setting indicator of claim 13, wherein each protrusion creates a cavity in the base.

15. The setting indicator of claim 14, wherein the cavity has a first volume in the pre-set position and a second smaller volume in the post-set position.

16. The setting indicator of claim 13, wherein each protrusion is disposed along the circumference of the base.

17. The setting indicator of claim 13, wherein each protrusion is formed in the base.

18. The setting indicator of claim 13, wherein each protrusion is attached to the base.

19. A packer actuator for use with a packer, the packer actuator comprising:

a body;

a dog assembly disposed on the body, the dog assembly being configured to set the packer when a force is applied to the packer actuator; and a setting indicator disposed between the dog assembly and a portion of the body, the setting indicator comprising a first ring member that is separated from a second ring member at a first distance when the setting indicator is in a pre-set position and at a second distance when the setting indicator is in a post-set position, the second distance being different than the first distance, wherein the setting indicator is configured to move from the pre-set position to the post-set position when the force is applied to the packer actuator.

20. The packer actuator of claim 19, wherein the first ring member is connected to the second ring member by a releasable connection when the setting indicator is in the post-set position.

21. The packer actuator of claim 19, wherein the second distance is smaller than the first distance.

22. The packer actuator of claim 19, wherein the second distance is larger than the first distance.

23. A packer actuator for use with a packer, the packer actuator comprising:

a body;

a dog assembly disposed on the body, the dog assembly being configured to set the packer when a force is applied to the packer actuator; and a setting indicator disposed between the dog assembly and a portion of the body, the setting indicator being configured to move from a pre-set position to a post-set position when the force is applied to the packer actuator, wherein the setting indicator is plastically deformed in the post-set position, and wherein the dog assembly and the setting indicator are disposed in a recess formed in the body.

24. A setting indicator for use with a packer actuator, the setting indicator comprising:

a first base member having a first protrusion that extends from the first base member; and a second base member having a second protrusion that extends from the second base member, wherein the first and second protrusions have a first height relative to the base members in a pre-set position and a second smaller height relative to the base members in a post-set position, each protrusion being plastically deformed when moved from the pre-set position to the post-set position by a force applied to the packer actuator.

25. The setting indicator of claim 24, wherein at least one of the first protrusion and the second protrusion is formed in the first base member or second base member.

26. The setting indicator of claim 24, wherein at least one of the first protrusion and the second protrusion is attached to the first base member or second base member.

27. The setting indicator of claim 24, wherein the first base member and the second base member at least partially form a shape of a ring.

* * * * *